US005294777A

United States Patent [19]

Denhup

[11] Patent Number: 5,294,777

[45] Date of Patent: Mar. 15, 1994

[54] HAIR CLIP FOR HEATING AND SHAPING ROOT-AREA HAIR PERPENDICULAR TO THE SCALP AND AN ELECTRIC HEATING UNIT FOR HEATING THE CLIPS

[75] Inventor: Paul Denhup, Stratford, Conn.

[73] Assignee: Clairol, Incorporated, New York, N.Y.

[21] Appl. No.: 900,626

[22] Filed: Jun. 18, 1992

[51] Int. Cl.[5] ..... A45D 1/02; A45D 2/36; A45D 4/00; H05B 3/00

[52] U.S. Cl. ..... 219/225; 132/206; 132/223; 132/229; 132/231; 219/230; 219/242

[58] Field of Search ..... 219/222-226, 219/230, 242; 132/118, 212, 223-225, 229-234, 236, 269, 227, 200, 210, 211, 206

[56] References Cited

U.S. PATENT DOCUMENTS

| | | | |
|---|---|---|---|
| 943,321 | 12/1909 | Shero | 132/224 |
| 1,465,838 | 8/1923 | Caneavri | 132/225 |
| 1,539,898 | 6/1925 | Franklin | 132/223 |
| 1,588,241 | 6/1926 | Leland | 132/224 |
| 1,719,232 | 7/1929 | Meade | 132/223 |
| 1,992,388 | 2/1935 | Moseley | 132/231 |
| 2,621,280 | 12/1952 | Judd | 132/229 X |
| 3,600,552 | 8/1971 | Tolmie | 219/242 X |
| 3,701,882 | 10/1972 | Wada et al. | 219/222 |
| 4,242,567 | 12/1980 | Carter | 132/224 X |

FOREIGN PATENT DOCUMENTS

| | | | |
|---|---|---|---|
| 121193 | 9/1971 | Denmark | 132/227 |
| 913814 | 6/1954 | Fed. Rep. of Germany | 132/227 |
| 2615267 | 10/1977 | Fed. Rep. of Germany | 132/232 |
| 194888 | 3/1938 | Switzerland | 219/242 |

*Primary Examiner*—Anthony Bartis
*Attorney, Agent, or Firm*—Anthony M. Santini

[57] ABSTRACT

A hair clip for heating and styling clasped hair, whether damp or dry, into a linear configuration in the scalp area of a user. The clip comprises a pair of biasable jaws including a pair of plates for storing heat and releasing such heat to style clasped hair held between the pair of plates. Supports extend laterally from the hair clip to permit it to freestand and heat and style the hair in a perpendicular fashion to the scalp, giving the remaining hair lift away from the scalp. The hair clips are heated by biasably gripping a heated plate positioned within a base structure of an electric heating unit. The heated hair clips are used in a method of styling dry or damp hair into a linear configuration generally perpendicular to the scalp.

15 Claims, 6 Drawing Sheets

HAIR CLIP FOR HEATING AND SHAPING ROOT-AREA HAIR PERPENDICULAR TO THE SCALP AND AN ELECTRIC HEATING UNIT FOR HEATING THE CLIPS

FIELD OF THE INVENTION

This invention relates to a heated hair clip for heating and shaping hair of the scalp and more particularly to a hair clip for heating and shaping hair in the scalp area so as to give lift and volume to the hair.

BACKGROUND OF THE INVENTION

Hair that is heated generally retains the configuration it had during the heating process. One current hair fashion is hair having lift or volume, that is, hair that stands out from the scalp so that it appears to have a full-bodied, natural look rather than either a flat or a curled look.

SUMMARY OF THE INVENTION

One way to accomplish lift is to treat hair next to the scalp, that is, root-area hair, in such a way that such hair will stiffen in a linear, or straight, configuration that is transverse, or generally perpendicular, to the scalp in contrast with the remaining hair, which retains the natural configuration that occurs when hair dries in a natural way. One way to stiffen root-area hair is to apply heat to damp or dry hair in the crown area of the scalp: the result is that root-area hair extending generally perpendicular from the scalp stiffens in a linear configuration so that the remaining hair is forced up away from the scalp, resulting in a desirable lift.

Accordingly, it is an object of the present invention to provide a heated hair clip that will give lift and volume to the hair of a user.

It is another object of the present invention to provide a heated hair clip that grips only hair proximate to the scalp in the crown area of the user without any danger of having the heated portion of the hair clip come into contact with the scalp and styles such hair in a linear configuration generally perpendicular to the scalp so that upon removal of the clip the formerly affixed hair retains the general configuration transverse to the scalp so that the hair in general of the user is given lift and volume.

It is another object of the present invention to provide a hair clip that is heated on a heating unit and subsequently affixed to the crown hair of a user in the scalp area so as to style such affixed hair in a linear configuration generally perpendicular to the scalp so that the hair achieves lift and volume.

Accordingly, in accordance with such objects and others that will become apparent in the course of this application, there is provided a hair clip for safely heating and styling clasped damp or dry hair into a linear configuration generally perpendicular to the scalp in the crown area of a user. The clip comprises a pair of jaws including a pair of plates storing heat and releasing such heat to style hair gripped between the pair of plates. The pair of jaws includes a pair of housings connected to the pair of plates for insulating the pair of plates to prevent contact with the scalp of the user. A hinge provides connection between the pair of jaws for rotatable movement between open and closed positions. The pair of plates have a generally flat relationship therebetween in the closed position, whereby hair gripped between the pair of plates is styled in a linear configuration. A leaf spring connected to the pair of housings provides a biasing relationship between the pair of jaws, the spring being movable between an unbiased mode wherein the pair of jaws are in the closed position and a biased mode wherein the pair of jaws are in the open position. A handle connected to the pair of jaws proximate to the hinge provides a grip to the user for pressuring the pair of jaws from the closed position to the open position.

Supports extending laterally from the bottom side of the housings maintain the hair clip along with the pair of plates in a generally perpendicular position relative to the scalp of the user when the flat plates grip the hair of the user. The bottom elongated edges of the housings and the supports define a concave configuration in general configuration with the human scalp.

A heating base structure made of a heat-insulative material supports a pair of vertical mounting plates for mounting and heating the hair clips. The biasable jaws of the hair clip biasably grip the mounting plates, which are electrically heated.

PRIOR ART

U.S. Pat. No. 1,949,766 issued to Merges on Apr. 13, 1976, discloses a spring-loaded hair clip with finger tip handles that control movable jaws. One jaw is comprised of a plurality of prongs and the other jaw comprises a heat-storing element having a single flat heating plate. The clip is intended to firmly clamp a wet hair curl between the heat-storing element and the other jaw.

Unlike the Merges disclosure, the present invention aims at safely creating hair lift or volume by styling a short distance of root-area hair of the crown of the user into a linear configuration that is transverse, or generally perpendicular, to the scalp so that the remaining hair is lifted away from the scalp and achieves desired volume.

Examination of Merges shows that the single plate of Merges will lie generally lateral to the scalp of the user and so could not be used to safely accomplish the task of the present invention as the user would risk burning her scalp by having the heated clip lie thereagainst. In particular, Merges cannot heat and style short lengths of hair, whether damp or dry, so that they stand perpendicular to the scalp; Merges shows only one heat-storing plate-jaw with the other jaw being a plurality of prongs, with the result that the hair could not stiffen in a linear configuration during the styling process; and Merges cannot be positioned freestanding immediately adjacent to the scalp of the user, since obviously Merges would tilt away from the scalp from a transverse alignment into a lateral alignment relative to the scalp so that the dried hair in turn would not be transverse to the scalp, with the result that that lift of the hair would not occur and safety to the user could not be provided.

DESCRIPTION OF THE PREFERRED EMBODIMENTS

Figure 1:
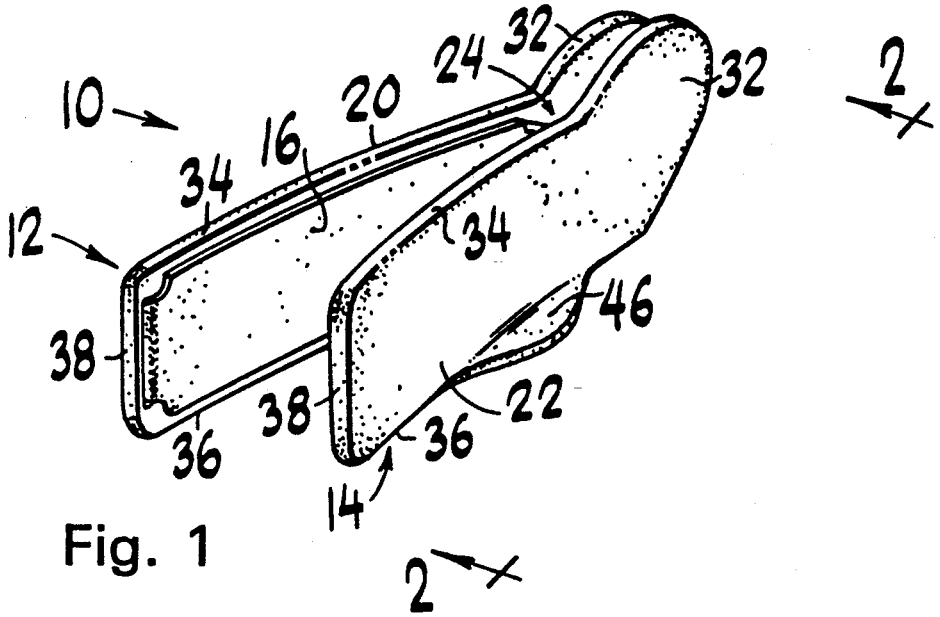
FIG. 1 illustrates in perspective view the heated hair clip in accordance with the present invention.

Reference is now made in detail to the drawing in which the same numerals refer to the same or similar elements throughout.

A hair clip 10 for heating and styling damp or dry hair into a linear configuration in the scalp area of the crown area of a user is shown in FIG. 1. Hair clip 10 includes a pair of jaws 12 and 14, which include a pair of generally rectangular flat metal plates 16 and 18, respectively, for storing heat and releasing such heat for styling the clasped damp or dry hair. Plates 16 and 18 are made of heat-retaining metal such as textured aluminum.

Housings 20 and 22 are connected to plates 16 and 18, respectively, for example, by heat staking. Housings 20 and 22 are made of a heat-insulation material, such as polycarbonate., to insulate the heat stored in plates 16 and 18 to prevent contact with the fingers or the scalp of the user.

Figure 3:
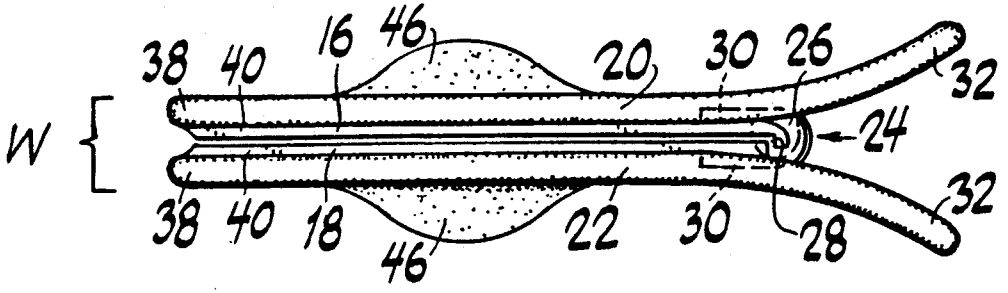
FIG. 3 is a view taken through line 3—3 of FIG. 2.
Figure 2:
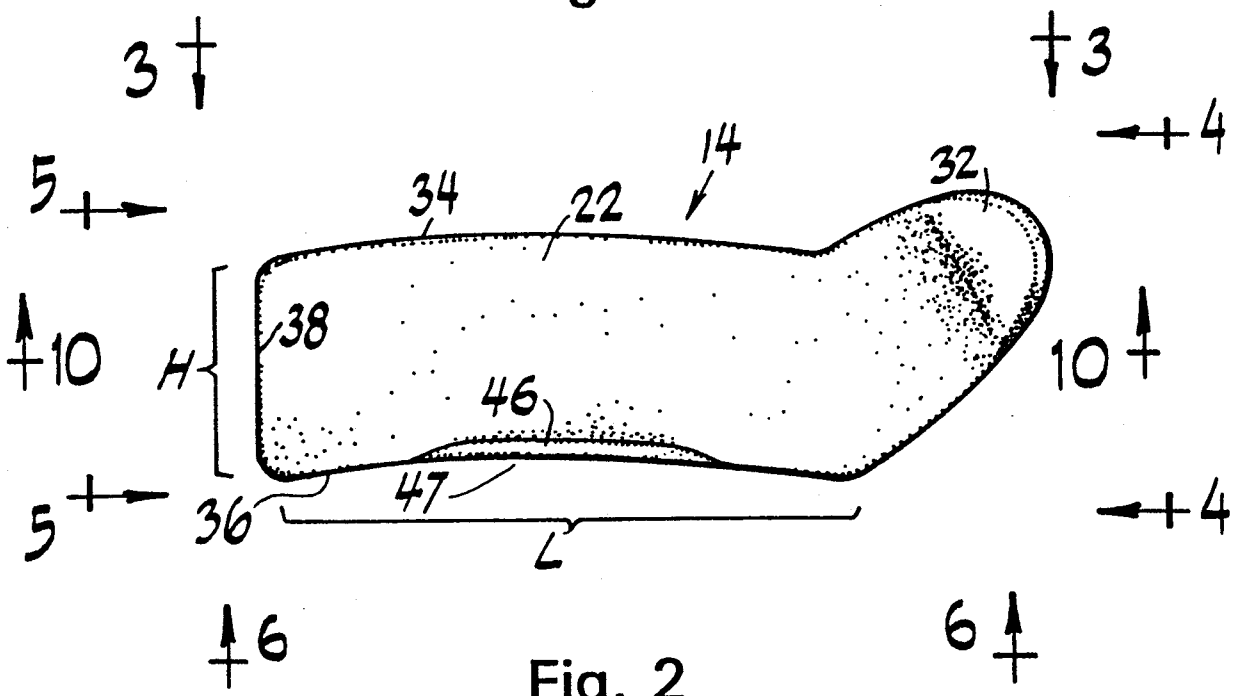
FIG. 2 is a view taken through plane 2—2 of FIG. 1.
Figure 4:
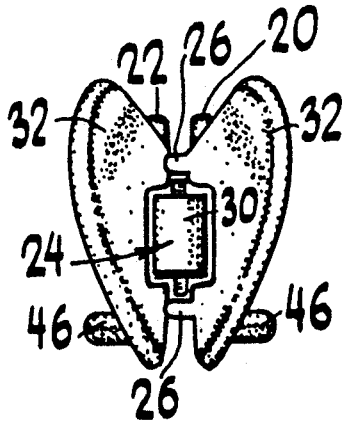
FIG. 4 is a view taken through line 4—4 of FIG. 2.
Figure 6:
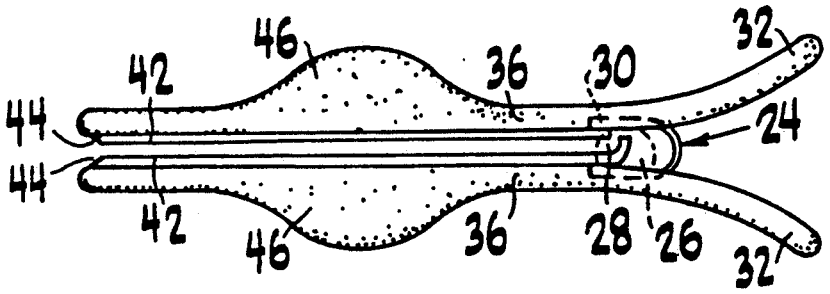
FIG. 6 is a view taken through line 6—6 of FIG. 2.

A hinge 24 provides connection between jaws 12 and 14 for rotatable movement between an open, or distal, position, and a closed, or proximate, position. As shown in FIGS. 3, 4, and 6, hinge 24 includes a pair of fulcrums 26 integral with one of the housings 20 or 22. Fulcrums 26 have curved ends about which housing 22 pivots relative to housing 20 while housings 20 and 22 carry plates 16 and 18 between the open and closed positions. Plates 16 and 18 may be rotatably mated at a rocker point 28 located at the area of hinge 24. Rocker point is is essentially comprised of an extended portion of plate 16 which extends beyond and partially around the hinge-side end of plate 18. Rocker point 28 allows rotatable movement of plate 16 about plate 18 between the closed and open positions. Plates 16 and 18 define a proximate flat relationship therebetween in the closed position when the clump of hair of the user is gripped, so that the hair is styled in a linear configuration, that is, the strands of hair are straight.

A resilient connection between plates 16 and 18 is provided by way of a leaf spring 30 that extends around rocker point 28 proximate hinge 24. Leaf spring 30 has a pair of leaf arms that are positioned in recesses defined by the hinge-side ends of plates 16 and 18 and the inner surfaces of housings 20 and 22 so that spring leaf 30 is anchored to the inner sides of housings 20 and 22. Leaf spring 30 is movable between an unbiased mode when plates 16 and 18 are in the proximate, or closed, position and a biased mode when plates 16 and 18 are in the distal, or open, position. The arms of spring leaf 30, which are anchored between plates 16 and 18 and housings 20 and 22, prevent jaws 12 and 14 from moving beyond the open position. Plates 16 and 18 are oriented in a generally perpendicular position relative to the scalp when the hair is gripped therebetween in the closed position.

A pair of finger-gripping handles 32, which are proximate hinge 24, are integral with housings 20 and 22, respectively. Handles 32 extend outwardly and upwardly so that a space is defined therebetween in the closed position which provides an area for handles 32 to come together when the user pressures housings 20 and 22 and consequently plates 16 and 18 from the unbiased mode, or closed position, to the biased mode, or open position.

Housings 20 and 22 have top edges 34, bottom edges 36, and front end edges 38 opposite hinge 24. Housings 20 and 22 cover plates 16 and 18, respectively, with top, bottom, and front end edges 34, 36, and 38, respectively, extending slightly beyond the top edges 40, the bottom edge 42, and the outer end edges 44 of plates 16 and 18. Bottom edges 36 of housings 20 and 22 extend in contact with the scalp of the user so that bottom edges 42 of plates 16 and 18 extend close to but are slightly spaced from the scalp of the user when plates 16 and 18 grip the hair of the user in the closed position so as to avoid direct contact with the scalp thus avoiding injury to the user.

In addition, the fingers of the user do not come into contact with top edge 40 and end edge 44 of heated plates 16 and 18. Jaws 12 and 14 in the closed position have a width W, a length L, and a height H relative to the scalp area of the user. The length L is greater than the height H, so that clip 10 grips root area hair in the long length orientation L and a short height orientation H.

A pair of supports, or feet, 46 extend transversely outwardly from bottom edges 36 of housings 20 and 22 laterally relative to the the scalp of the user when clip 10 is positioned on the user's crown. Feet 46 maintain, or stabilize, the generally perpendicular position of housings 20 and 22 when plates 16 and 18 are in the closed position, gripping the hair of the user, so that hair clip 10 freestands on the scalp during the heating and styling process.

Bottom edges 36 of housings 20 and 22 along with feet 46 define a concave contour 47 in the lengthwise L orientation, that is, between hinge 24 and front end edges 38 in general conformity with the scalp of a human so that the hair is clasped as close as possible to the entire root-area.

Figure 5:
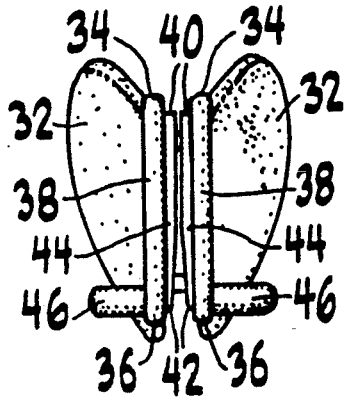
FIG. 5 is a view taken through line 5—5 of FIG. 2.

As seen in FIG. 5, in the closed position of jaws 12 and 14, top edges 40 of plates 16 and 18 are closer to one another than bottom edges 42. Thus, an angular lead 44 is formed so that the heat in plates 16 and 18 tends to be directed towards the root area hair of the scalp and closed off from escape from the top side along top edges 40. Lead 44 further allows for the greater thickness of hair, generally present in the root area of the scalp, to be firmly and easily gripped. Consequently, lead 44 transfers heat to a greater surface area of the hair (at the root), providing the optimal degree of hair lift.

Figure 9:
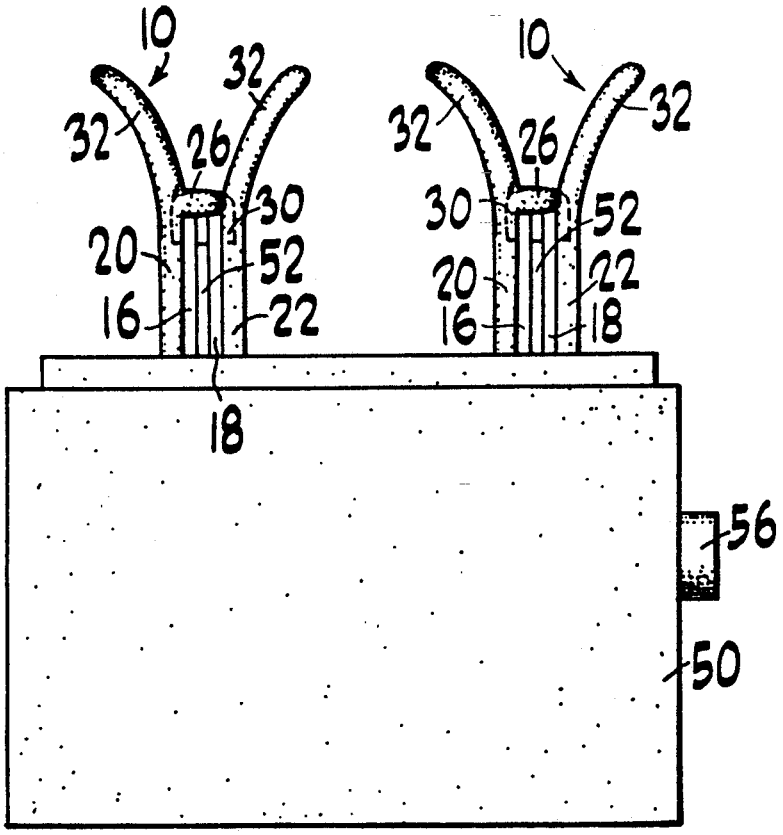
FIG. 9 is a view taken through taken through plane 9—9 of FIG. 8.
Figure 7:
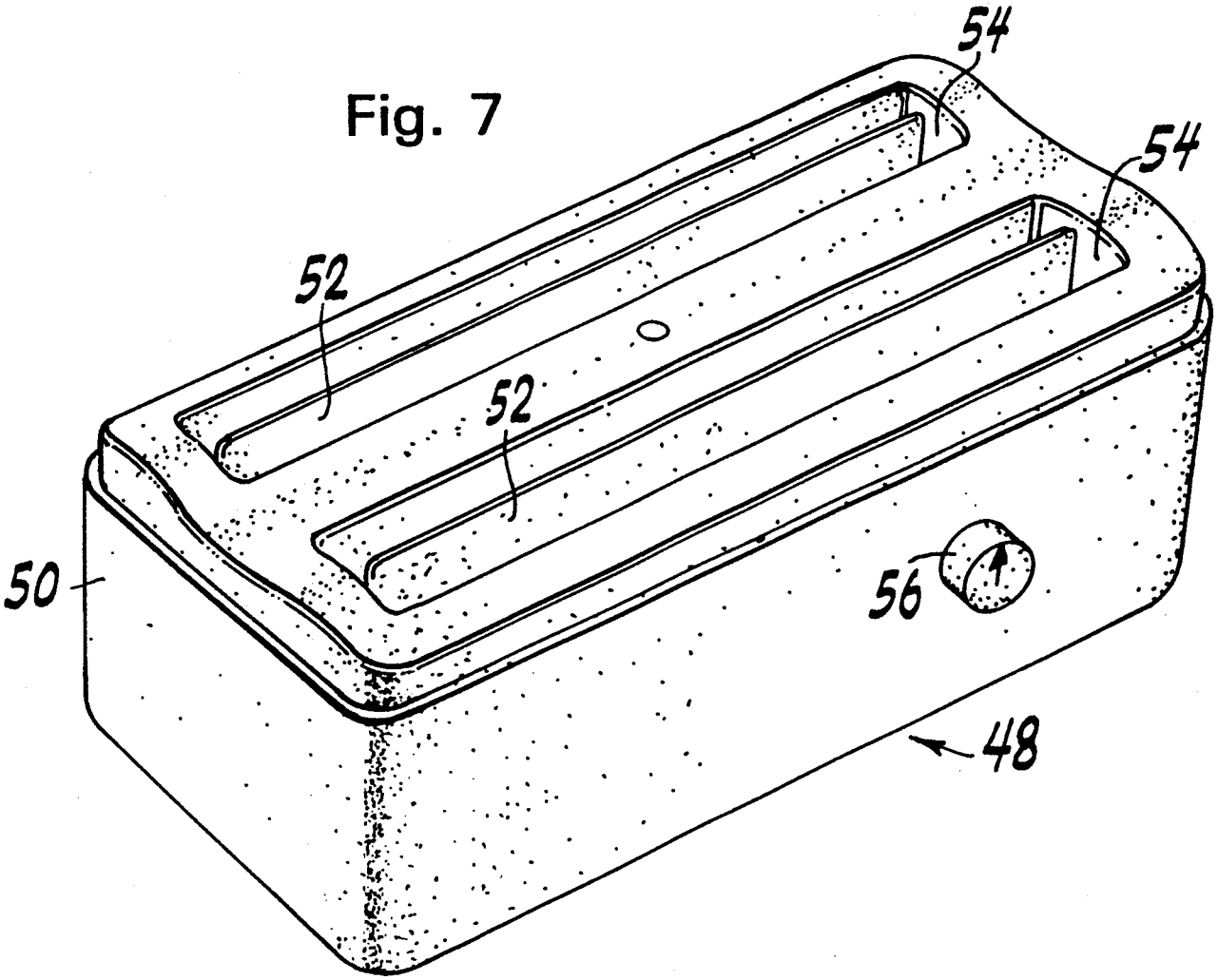
FIG. 7 illustrates a heating base for the heated hair clip in perspective view.
Figure 8:
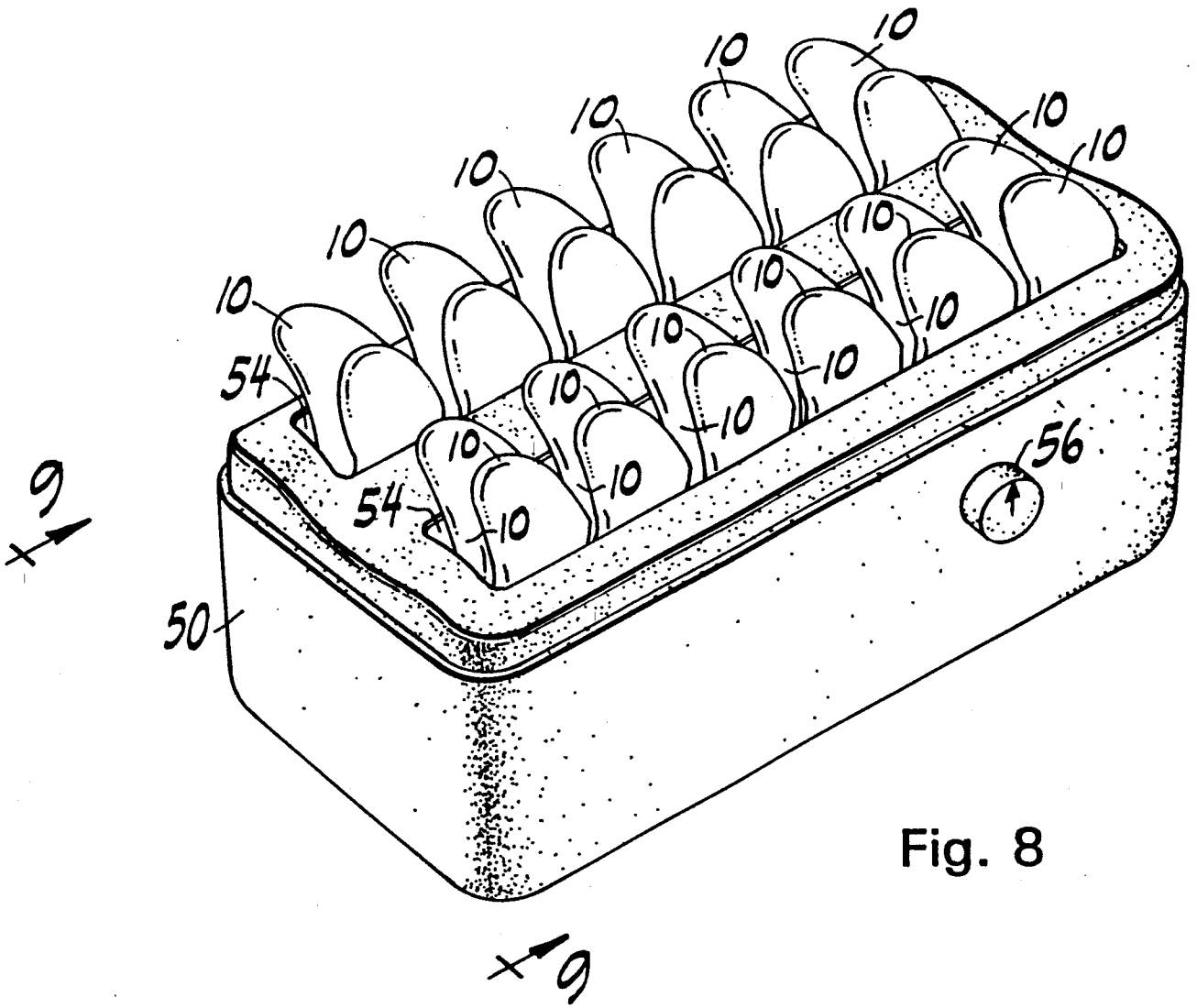
FIG. 8 illustrates the heating base shown in FIG. 7 with a plurality of hair clips mounted thereon for heating in perspective view.
Figure 10:
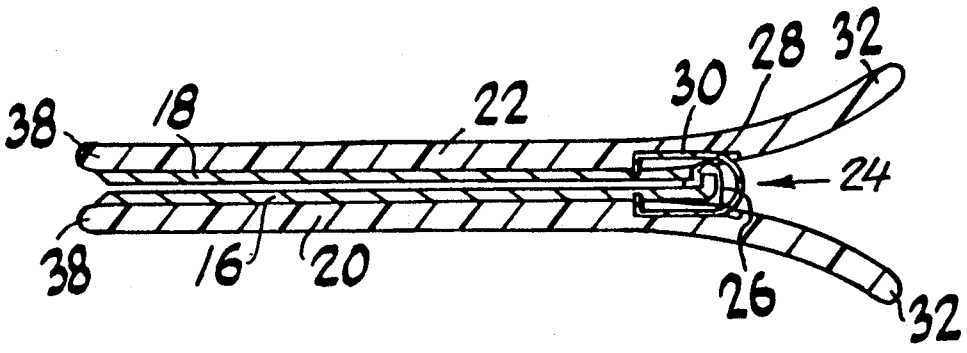
FIG. 10 is a longitudinal sectional view taken through line 10—10 of FIG. 2.

FIGS. 7, 8 and 9 illustrate a heating unit 48 for heating a plurality of hair clips 10. Heating unit 48 includes a base structure 50 made of a heat-insulative material such as polycarbonate. A pair of flat metal plates 52 made of a heat transferable material are connected to and mounted within a pair of elongated parallel rectangular recesses 54 defined by base structure 50 in spaced parallel relationship. A plurality of hair clips 10 are mounted to and biasably held in gripping relationship to plates 52.

Plates 52 are electrically heated from a source of electrical power, such source being either an internal electrical power unit or an external source of electrical power. A thermostatic control 56 is mounted to base structure 50 and in operative connection with the electrical power.

The present invention includes a method of styling dry or damp root-area hair of the scalp into a linear configuration in accordance with the following steps:

a. heating pair of jaws 12 and 14 of hair clip 10, in particular the pair of flat, heat-storing metal plates 16 and 18, in heating unit 48 and upon heating removing pair of jaws 12 and 14 from heating unit 48;

b. moving pair of jaws 12 and 14 with heated plates 16 and 18 into an open position; in this step, pair of jaws 12 and 14 are initially held in an unbiased position by spring 30 and the step includes forcing pair of jaws 12 and 14 apart from the biased closed position to a biased position;

c. positioning pair of open jaws 12 and 14, including pair of plates 16 and 18, in a generally perpendicular position relative to and proximate to the scalp of the user with root-area hair of the user being located between pair of plates 16 and 18; in this step, housings 20 and 22 are positioned so as to protect the scalp of the user.

d. moving pair of plates 16 and 18 from the open position to the closed position and grasping the root-area hair between closed jaws 12 and 14 with the root-area hair being oriented in a linear configuration generally perpendicular to the scalp of the user. In this step, supports 46 maintain a generally perpendicular position of said clip relative the scalp of the user. This step includes releasing jaws 12 and 14 from the biased position and allowing spring 30 to move jaws 12 and 14 to the unbiased position.

e. allowing heated pair of plates 16 and 18 to pass the stored heat from the plates 16 and 18 to the grasped hair;

f. moving pair of jaws 12 and 14 from the closed position to the open position and removing clip 10 from the scalp of the user; this step includes forcing jaws 12 and 14 from the unbiased position to the biased position.

Although the present invention has been described in some detail by way of illustration and example for purposes of clarity and understanding, it will, of course be understood that various changes and modifications may be made in the form, details, and arrangements of the parts without departing from the scope of the invention set forth in the following claims.

What is claimed is:

1. A hair clip for heating and styling clasped hair into a linear configuration in the scalp area of a user, comprising, in combination, a pair of jaws, said pair of jaws including a pair of plates having a generally flat relationship therebetween for storing heat and releasing such heat for styling clasped hair held between said pair of plates into a linear configuration, said pair of jaws further including means connected to said pair of plates for housing said pair of plates, hinge means for providing connection between said pair of jaws for movement between open and closed positions, biasing means for providing biased movement between a biased mode wherein said pair of jaws are in the open position and an unbiased mode wherein said pair of jaws are in the closed position, handle means connected to said pair of jaws for providing a grip to the user for pressuring said pair of jaws from the closed position to the open position, and support means integral with said clip for maintaining a generally perpendicular position of said clip upon the scalp of the user when said pair of jaws are gripping the hair of the user.

2. The clip set forth in claim 1, wherein said pair of plates are generally rectangular and have inner and outer sides and opposed top and bottom edges and opposed rear end and front end edges, said front end edge being transverse to said top and bottom edges, and said housing means covers said outer sides and extends beyond said top, bottom, front end and rear end edges.

3. The clip set forth in claim 1 wherein said support means are connected to said housing means.

4. The clip set forth in claim 3, wherein said housing means includes a pair of housings made of a heat insulative material, said pair of housings having bottom edges relative to being positioned on the scalp of the user, and wherein said support means includes a pair of projections extending laterally outwardly from said bottom edges.

5. The clip set forth in claim 4, wherein said bottom edges and said projections define a concave configuration in general conformity with a human scalp along said bottom edges between said rear end and said front end edges of said pair of jaws.

6. The clip set forth in claim 1, wherein said biasing means is a leaf spring connected to said housing means proximate said hinge means.

7. The clip set forth in claim 1, wherein said pair of plates have opposed top and bottom plate edges, said top plate edges being proximate in the closed position and said bottom plate edges being slightly spaced apart in the closed position.

8. A heating unit for heating hair clips comprising, in combination, at least one hair clip as defined in claim 1, a base structure plate mans positioned within said base structure, means for heating said plate means, and said at least one hair clip biasably gripping said plate means with said pair of plates in heat transferable contact therewith.

9. The heating unit according to claim 8, wherein said plate means includes at least one vertical flat plate made of a heat-transferable material.

10. The heating unit according to claim 9, wherein said material is a metal.

11. The heating unit according to claim 9, wherein said base structure defines a recess, said at least one vertical flat plate being positioned within said recess.

12. The heating unit according to claim 11, wherein said at least one flat plate is a plurality of spaced parallel flat plates positioned within said recess.

13. The heating unit according to claim 8, wherein said base structure is made of polycarbonate.

14. The heating unit according to claim 8, wherein said means for heating is electrical power.

15. The heating unit according to claim 13, further including a thermostatic control mounted to said base structure connected to said electrical power.

* * * * *